US008939349B2

(12) United States Patent
Lerner

(10) Patent No.: US 8,939,349 B2
(45) Date of Patent: Jan. 27, 2015

(54) DISPOSABLE CUP

(71) Applicant: Dmitry Lerner, New York, NY (US)

(72) Inventor: Dmitry Lerner, New York, NY (US)

( * ) Notice: Subject to any disclaimer, the term of this patent is extended or adjusted under 35 U.S.C. 154(b) by 0 days.

(21) Appl. No.: 13/792,318

(22) Filed: Mar. 11, 2013

(65) Prior Publication Data

US 2013/0240544 A1 Sep. 19, 2013

Related U.S. Application Data

(60) Provisional application No. 61/611,117, filed on Mar. 15, 2012.

(51) Int. Cl.

| | |
|---|---|
| ***B65D 3/28*** | (2006.01) |
| ***A47G 19/22*** | (2006.01) |
| ***B31B 3/14*** | (2006.01) |
| ***B65D 1/26*** | (2006.01) |
| ***B65D 3/06*** | (2006.01) |

(52) U.S. Cl.

CPC ..... *A47G 19/2266* (2013.01); *B31B 3/14* (2013.01); *B65D 1/265* (2013.01); *B65D 3/06* (2013.01); *B65D 3/28* (2013.01); *B65D 2231/005* (2013.01)

USPC ..... 229/103.1; 206/217; 220/710; 229/400; 229/401

(58) Field of Classification Search

CPC ..... B65D 77/286

USPC ..... 229/103.1, 401; 220/710

See application file for complete search history.

(56) References Cited

U.S. PATENT DOCUMENTS

| | | | | | |
|---|---|---|---|---|---|
| 1,213,961 | A * | 1/1917 | Shepard | 229/103.1 |
| 2,355,010 | A * | 8/1944 | Pera | 220/710 |
| 3,272,418 | A * | 9/1966 | Morse et al. | 229/400 |
| 3,406,868 | A * | 10/1968 | Rogers | 220/710 |
| 3,921,889 | A * | 11/1975 | Gibbons | 229/103.1 |
| 5,423,476 | A * | 6/1995 | Ferrer | 229/103.1 |
| 5,495,982 | A * | 3/1996 | Wang | 229/103.1 |
| 6,019,277 | A * | 2/2000 | Lundstrom | 229/103.1 |
| 6,155,478 | A * | 12/2000 | Yang | 229/103.1 |
| 8,052,003 | B2 * | 11/2011 | Burns | 220/705 |
| 8,505,807 | B2 * | 8/2013 | Herman | 229/404 |
| 2005/0284874 | A1 * | 12/2005 | Lucks | 220/712 |
| 2006/0169759 | A1 * | 8/2006 | Sarson et al. | 229/400 |

FOREIGN PATENT DOCUMENTS

WO WO-86/04314 A1 * 7/1986 ..... B65D 77/286

* cited by examiner

*Primary Examiner* — Gary Elkins

(74) *Attorney, Agent, or Firm* — Deborah Gador

(57) ABSTRACT

The present invention relates to a cup with a built-in straw and a method of making it. The cup is made from a blank including a flat body portion having a top and bottom edge and two side edges. A first cut-away along the top edge of the body portion defines two portions along the side edges and extending beyond the top edge. A second cut-away is formed adjacent one of the side edges. The body portion is configured to be folded such that the first extending portion is in registration with the second extending portion, and a first side edge of the body portion engages an outer wall of the body portion while the second side edge engages an inner wall of the body portion, to form a cup body with a built-in straw on an inside wall of the cup body with the second cutaway inside the cup body.

2 Claims, 5 Drawing Sheets

DISPOSABLE CUP

RELATED APPLICATIONS

This application claims the benefit of U.S. provisional application Ser. No. 61/611,117 filed 15 Mar. 2012.

FIELD OF THE INVENTION

The present invention relates to drinking utensils in general, and, in particular, to disposable drinking cups with straws.

BACKGROUND OF THE INVENTION

There are known disposable paper and Styrofoam® cups that are designed for one-time use and disposal. There are also known disposable and re-usable cups that have straws built into them as an integral part of the cup. The use of a straw can help prevent accidental spills of liquids contained in the cup, spills which can lead to burns or stains. However, the prior art disposable cups with built-in straws are formed from a blank or sheet that requires the straw to be folded separately from and prior to folding the body of the cup. This makes them difficult to produce and expensive to make.

There is, therefore, a long-felt need for a disposable cup with a built-in straw that can be formed in a manner that is easy to implement and relatively inexpensive.

SUMMARY OF THE INVENTION

The present invention relates to a disposable drinking cup with a built-in straw made from a one-piece blank or sheet of paper or other disposable material. This blank includes a first straw portion and a second straw portion and, when it is folded, the first and second straw portions are aligned in registration with one another to form a disposable cup with walls and a complete straw made from combining the first straw element and the second straw element.

According to the present invention, there is provided a method for forming a disposable cup with a straw, the method including providing a blank for a cup including a flat body portion having a top and bottom edge and two side edges, a first cut-away portion of the top edge of the body portion defining two portions along the side edges extending beyond the top edge, and a second cut-away portion adjacent one of the side edges, folding the body portion so that the first extending portion is in registration with the second extending portion and causing the first side edge of the body portion to engage to an external wall of a cup body and the second side edge to engage an internal wall of the body portion to form a cup body with a built-in straw on an inside wall with the second cut-away inside the cup body.

According to preferred embodiments of the invention, the method further includes affixing a bottom closure to the body portion.

There is also provided, according to the invention, a method for making a blank, the method including providing a flat body portion having a top and bottom edge and two side edges, cutting away a portion of the top edge of the body portion to define two portions along the side edges extending beyond the top edge, and cutting away a second portion adjacent one of the side edges, wherein the body portion is configured to be folded such that the first extending portion is in registration with the second extending portion, and a first side edge of the body portion is sealed to an outer wall of the body portion and the second side edge is sealed to an inner wall of the body portion, to form a cup body with a built-in straw on an inside wall with the second cutaway inside the cup body.

There is further provided, according to the invention, a blank for a disposable drinking cup, the blank including a flat body portion having a top and bottom edge and two side edges, a first cut-away along the top edge of the body portion defining two portions along the side edges and extending beyond the top edge, and a second cut-away formed adjacent one of the side edges, wherein the body portion is configured to be folded such that the first extending portion is in registration with the second extending portion, and a first side edge of the body portion engages an outer wall of the body portion and the second side edge engages an inner wall of the body portion, to form a cup body with a built-in straw on an inside wall of the cup body with the second cutaway inside the cup body.

According to some embodiments, the blank further includes an integral bottom closure element.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a disposable drinking cup with a built-in straw and a method for making it. A unique one-piece blank allows the built-in straw to be made with the same folding action that forms the body of the cup. Thus, the straw is constructed at the same time and with the same actions that are used to construct the cup. This saves substantial time and resources in manufacturing the cups.

It will be appreciated that the straw of the present invention is similar in function to a conventional detached straw, available at most popular food chains and used to consume liquids, but is formed as an integral part of the cup, or other drinking utensil, at the time of manufacture. The straw allows the user to consume liquids from near the bottom of the cup. The cup can be designed for use with hot or cold beverages and it can be made in a variety of shapes and sizes, for example, tall cups, short cups, thermos cups, side intrusions, bottom attachments, and the like. Preferably, the materials used to make the cups are eco-friendly and biodegradable or recyclable, so they have a smaller ecological impact than conventional waxed paper or Styrofoam® cups.

Preferably, the straw can be used in conjunction with a cover for the disposable cup used to cover the top of the cup and prevent spills. In this case, liquid can be drunk from the cup through the straw without requiring the drinker to remove the cover. As in conventional cups, removal of the cover can lead to vibration and cause spillage of liquid inside.

Figure 1:
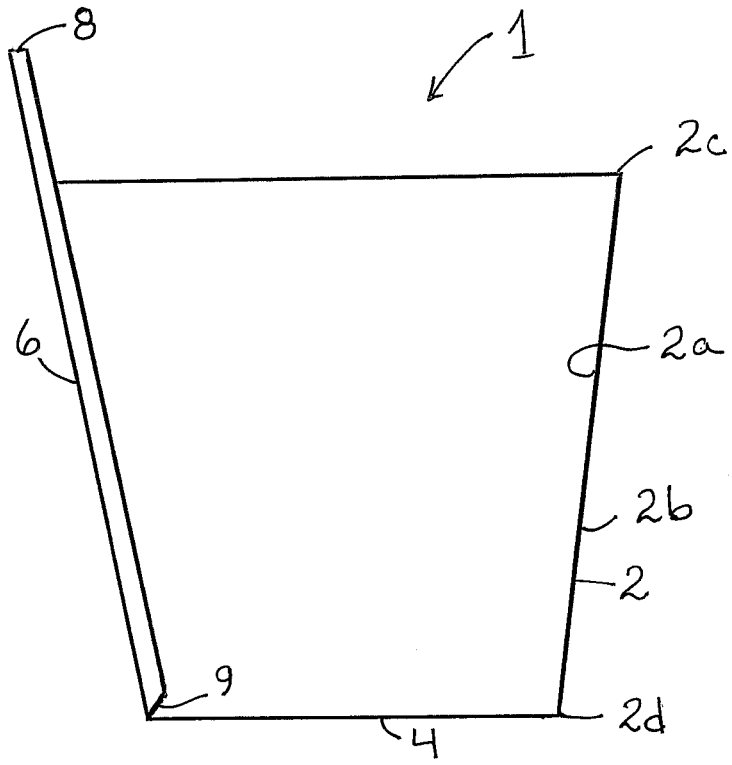
FIG. 1 is a sectional side view of a disposable cup with straw, constructed and operative in accordance with one embodiment of the present invention.
Figure 5:
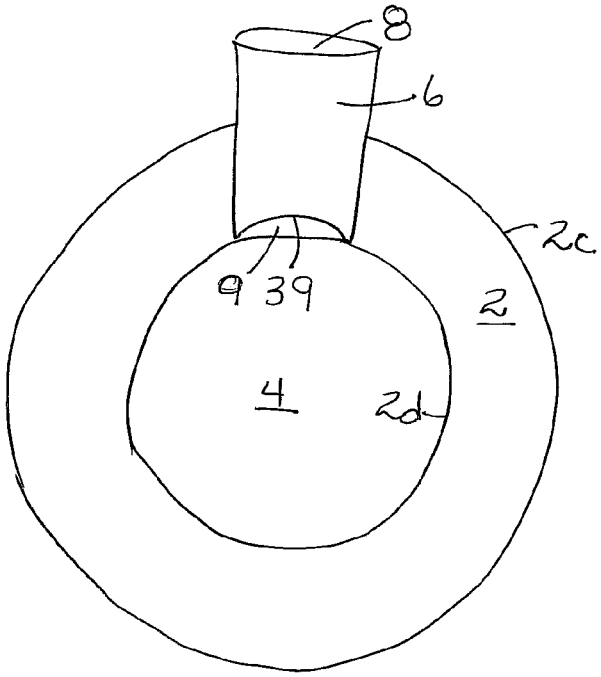
FIG. 5 is a top perspective view of a completed disposable cup with straw, constructed and operative in accordance with one embodiment of the present invention.

FIG. 1 is a side view of one embodiment of a completed disposable cup 1 of the present invention. Cup 1 includes a body 2, a bottom 4 and a built-in straw 6. Body 2, in the completed cup, defines an inner wall 2*a* and an outer wall 2*b*, as well as an upper edge 2*c* and a lower edge 2*d*. Straw 6 is integrally formed with body 2. As described in greater detail below, straw 6 is formed from a first straw portion 6*a* and a second straw portion 6*b* integrally formed with body 2. An upper portion of straw 6 extends vertically above upper edge 2*c* of cup 1 and merges into an upper straw tube opening 8. Straw 6 extends vertically towards the bottom 4 of cup 1, and merges into a lower straw opening 9 inside the finished cup 1. Lower straw opening 9 includes a cut-away of any geometric shape, illustrated in the embodiment of FIG. 5 as being arcuate.

Figure 2:
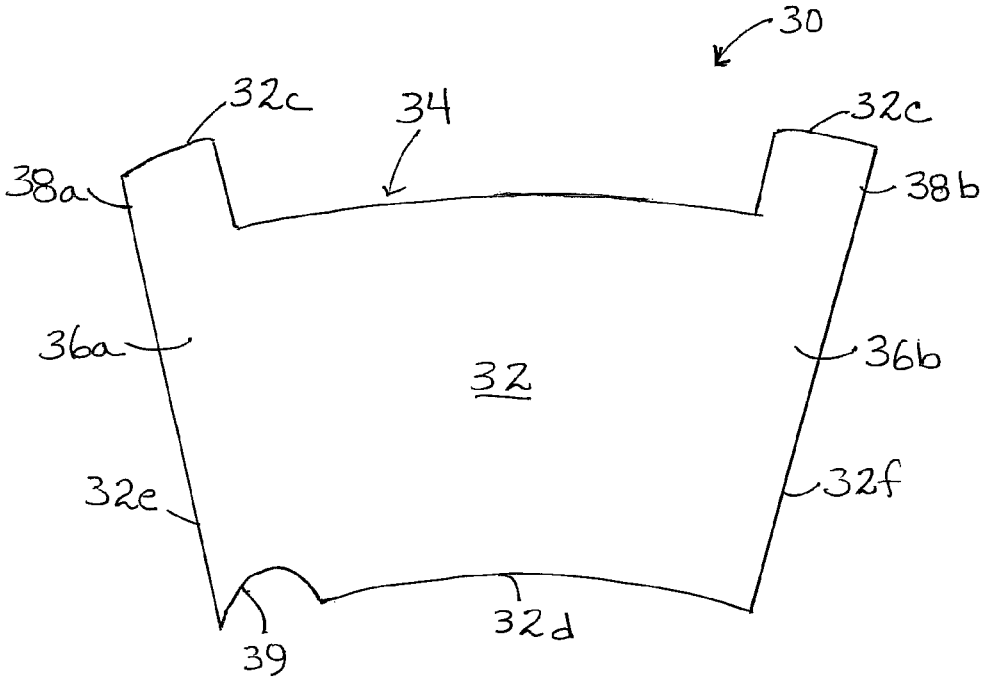
FIG. 2 is a plan view of a blank for a disposable cup, according to one embodiment of the present invention.
Figure 3:
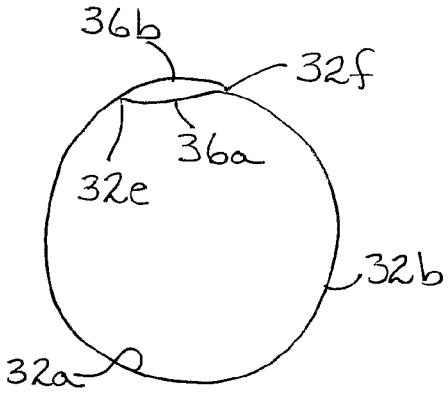
FIG. 3 is a top view of the blank for a disposable cup of FIG. 2 during construction of the disposable cup with straw, according to one embodiment of the present invention.

FIG. 2 is a plan view of a flat blank 30 for a disposable cup, according to one embodiment of the present invention. FIG. 3 is a top view of blank 30 when folded to form a cup body. Blank 30 defines a body portion 32. Body portion 32 defines an inner wall 32*a* and an outer wall 32*b* (best seen in FIG. 3), as well as an upper edge 32*c*, a lower edge 32*d*, and two side edges 32*e* and 32*f*. A first cut-away 34 is provided along upper edge 32*c* of body portion 32 and defines a first straw portion 36*a* adjacent side edge 32*e* of body portion 32 and a second straw portion 36*b* adjacent side edge 32*f* of body portion 32. First straw portion 36*a* includes a drinking portion 38*a* extending vertically beyond top edge 32*c*. Second straw portion 36*b* includes a drinking portion 38*b* extending vertically beyond top edge 32*c*. A second cut-away 39 is formed in first straw element 36*a*, i.e., adjacent one of the side edges of the body portion, preferably towards the lower edge 32*d* of body portion 32, that will serve as the lower straw opening in the finished cup.

Figure 4:
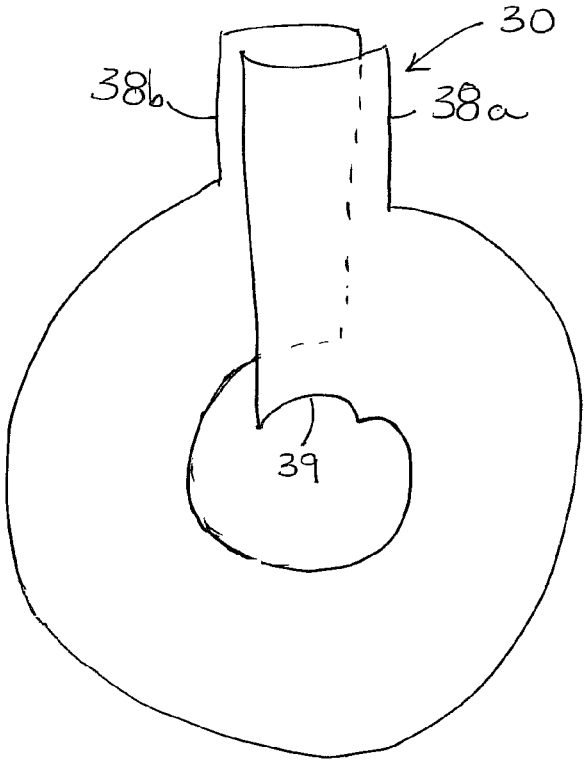
FIG. 4 is a perspective top view of the blank for a disposable cup of FIG. 2 during construction of the disposable cup with straw, according to one embodiment of the present invention.

One example of a method for forming a disposable cup with a built-in straw will now be described with reference to FIGS. 2 to 4. Body portion 32 is rolled or folded to form a cup body until the outer surface of first straw portion 36*a* (and extending drinking portion 38*a*) and the inner surface of second straw portion 36*b* (and extending drinking portion 38*b*) are in registration with one another (overlap). In this position, second side edge 36*b* of body portion 32 engages outer wall 32*b* of the body portion and first side edge 36*a* engages inner wall 32*a* of body portion 32. In this way, a cup body with a built-in straw on the inside wall of the cup body if formed, with the second cut-away 39 inside the folded cup body. Cut-out 39 provides an opening into straw 36, preferably adjacent the bottom of the cup and, when blank 30 is folded and sealed, forms the lower straw opening.

Preferably, the side edges of extending drinking portions 38*a* and 38*b* are sealed to one another along their side edges, forming the upper straw tube opening. At the same time, second side edge 32*f* of body portion 32 is sealed to outer wall 32*b* of the body portion, and first side edge 32*e* is sealed to inner wall 32*a* of body portion 32 by any suitable type of seal, for example, a non-toxic adhesive, or heat sealing, forming a completed cup body and a completed straw 36 by a single folding action.

Figure 6:
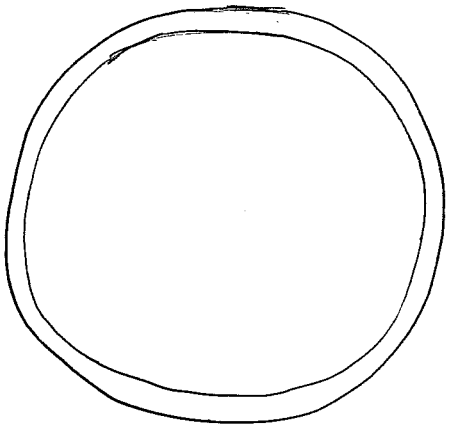
FIG. 6 is a top view of a bottom portion for a disposable cup, constructed and operative in accordance with one embodiment of the present invention.
Figure 7:
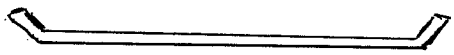
FIG. 7 is a side view of the bottom portion for a disposable cup of FIG. 6, according to one embodiment of the present invention.

Folding the blank body 30 in this way creates the inner and outer walls 32*a* and 32*b* of the completed cup. Preferably, while blank 30 is being folded, a bottom closure element 40 (best seen in FIGS. 6 and 7) is inserted adjacent and affixed to the bottom edge 32*d* of body portion 32, in any conventional manner. Bottom closure element 40 may be die-punched or formed in any other manner, and it is preferably made from the same disposable material as blank 30. When blank 30 is sealed, this bottom closure element 40 will form the bottom wall or base (4) of the cup. Alternatively, the bottom closure element can be integrally formed as part of blank 30 on the bottom edge 32*d* of the blank body 32. The blank 30 is sealed using any known sealing means, which may include, but is not limited to hot wax, non-toxic adhesive, heat sealing, or any other method, and a complete cup 1 with straw 6, walls 2 and bottom 4 is formed, as shown in top perspective view in FIG. 5.

Figure 8:
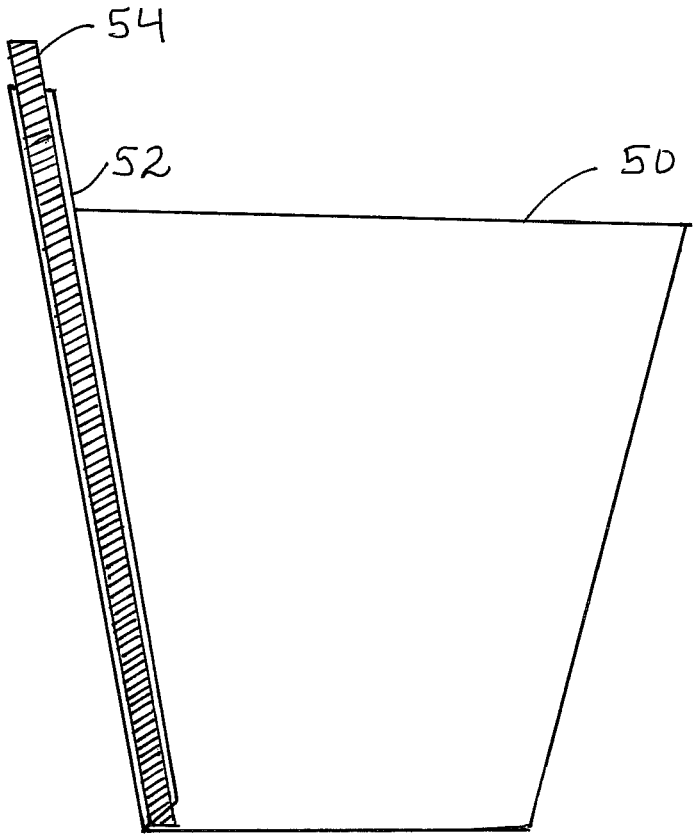
FIG. 8 is a side sectional view of a disposable cup with straw, constructed and operative in accordance with another embodiment of the present invention.

According to some embodiments of the invention, as shown, for example, in FIG. 8, a stirrer 54 may be provided in straw 52 of a disposable cup 50 constructed from a blank according to the invention. Stirrer 54 may be formed of any suitable rigid but non-toxic material, such as plastic, wood, cardboard. During packaging of a plurality of disposable cups according to the invention, stirrer 54 maintains straw 52 in an open orientation and prevents crushing or deformation of the straw. When a user wishes to drink from the cup, stirrer 54 is removed from the straw and can be used to stir a beverage in the cup, before being disposed of.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A method for forming a disposable cup with a straw, the method comprising:

providing a blank for a cup including:

a flat body portion having an inner wall, an outer wall, a top edge, a bottom edge, a first side edge and a second side edge;

a first cut-away portion of the top edge of the body portion defining a first extending portion along the first side edge having an outer surface, and a second extending portion along the second side edge having an inner surface, both extending portions extending beyond the top edge; and a second cut-away portion adjacent one of the side edges;

rolling the body portion to form a cup body so that the outer surface of the first extending portion is in registration with the inner surface of the second extending portion;

sealing said inner wall of the first side edge of the body portion to said outer wall of the body portion and sealing said outer wall of the second side edge to said inner wall of the body portion to form the cup body with a built-in straw on the inner wall of the cup body with the second cut-away inside the cup body; and sealing said first extending portion to said second extending portion along their side edges, thereby forming a built-in straw upper portion extending beyond the top edge of the cup body;

further comprising inserting a stirrer into the straw in the rolled cup body during manufacture, thereby maintaining the straw in an open orientation and preventing crushing or deformation of the straw during packaging and transportation.

2. A method for forming a disposable cup with a straw, the method comprising:

providing a blank for a cup including:

a flat body portion having an inner wall, an outer wall, a top edge, a bottom edge, a first side edge and a second side edge;

a first cut-away portion of the top edge of the body portion defining a first extending portion along the first side edge having an outer surface, and a second extending portion along the second side edge having an inner surface, both extending portions extending beyond the top edge; and a second cut-away portion adjacent one of the side edges;

rolling the body portion to form a cup body so that the outer surface of the first extending portion is in registration with the inner surface of the second extending portion;

sealing said inner wall of the first side edge of the body portion to said outer wall of the body portion and sealing said outer wall of the second side edge to said inner wall of the body portion to form the cup body with a built-in straw on the inner wall of the cup body with the second cut-away inside the cup body;

sealing said first extending portion to said second extending portion along their side edges, thereby forming a built-in straw upper portion extending beyond the top edge of the cup body;

affixing a bottom closure to said body portion; and inserting a stirrer into the straw in the rolled cup body during manufacture, thereby maintaining the straw in an open orientation and preventing crushing or deformation of the straw during packaging and transportation.

* * * * *